US005179877A

United States Patent [19]

Down et al.

[11] Patent Number: 5,179,877

[45] Date of Patent: Jan. 19, 1993

[54] TAMPER-RESISTANT CABLE TERMINATOR SYSTEM

[75] Inventors: William J. Down, Phoenix; Robert D. Hayward, Glendale, both of Ariz.

[73] Assignee: Gilbert Engineering Company, Inc., Phoenix, Ariz.

[21] Appl. No.: 715,791

[22] Filed: Jun. 14, 1991

Related U.S. Application Data

[60] Division of Ser. No. 402,815, Sep. 5, 1989, Pat. No. 5,055,060, which is a continuation-in-part of Ser. No. 360,777, Jun. 2, 1989, abandoned.

[51] Int. Cl.[5] ..... B25B 23/00

[52] U.S. Cl. ..... 81/443; 81/442

[58] Field of Search ..... 81/53.2, 442, 443

[56] References Cited

U.S. PATENT DOCUMENTS 2,455,005 11/1948 Hall ..... 81/443

2,556,945 6/1951 Roddick ..... 81/443

FOREIGN PATENT DOCUMENTS 120783 of 1918 United Kingdom ..... 81/443

*Primary Examiner*—D. S. Meislin

*Attorney, Agent, or Firm*—Don J. Flickinger; Jordan M. Meschkow; Lowell W. Gresham

[57] ABSTRACT

A tamper-resistant terminator includes a connector body rotatably encapsulated within a shield. A port in the shield receives a terminal of a cable transmission system therethrough for rotational engagement with a threaded bore within the connector body. Another port in the shield provides access to a socket defined by a smooth continuous cylindrical body. The socket and the threaded bore extend in opposite directions along a longitudinal axis about which the shield is freely rotatable. A tool includes a tubular shaft having a knurled portion at the free end extends from a first handle section. A disc residing adjacent the end of the tubular shaft is carried by a shaft rotatably journaled with the tubular shaft and drivingly engaged with a second handle section. In response to relative rotation between the handle sections the disc and the knurled section of the tubular shaft move between a concentric portion for telescoping movement within the socket of the connector body and an eccentric position in for driving engagement with the socket.

2 Claims, 3 Drawing Sheets

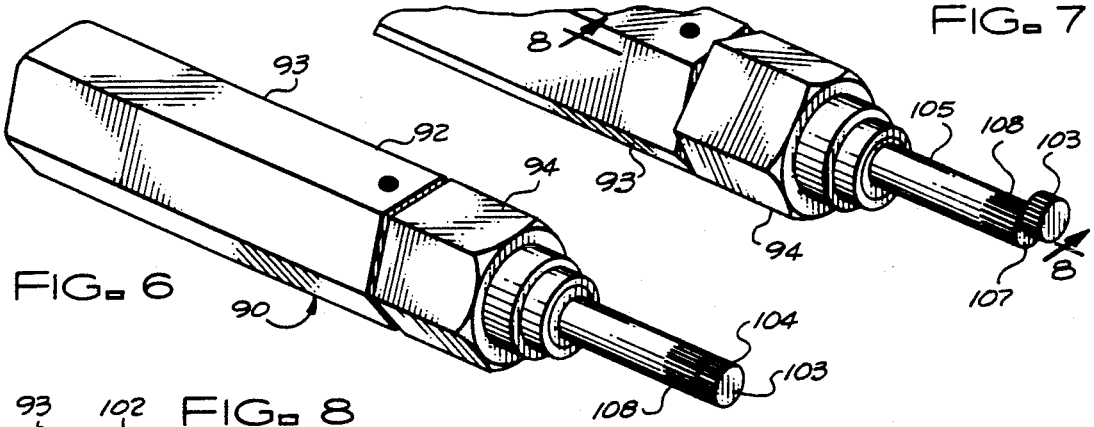
FIG. 6
FIG. 7
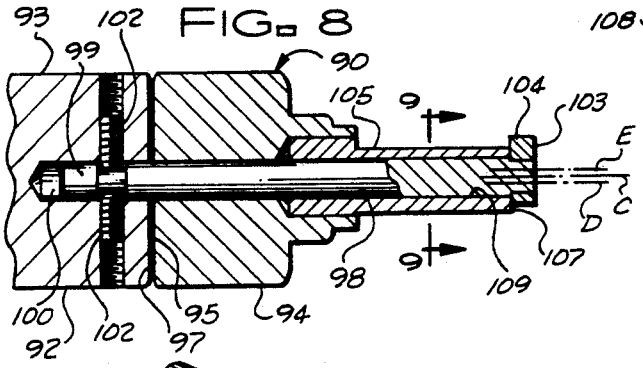
FIG. 8
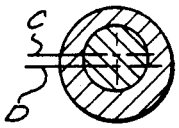
FIG. 9
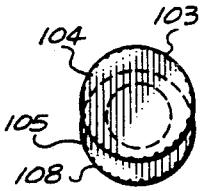
FIG. 10
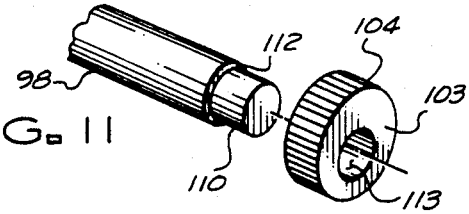
FIG. 11
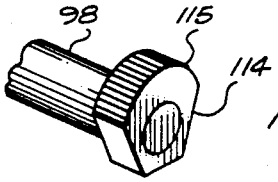
FIG. 12
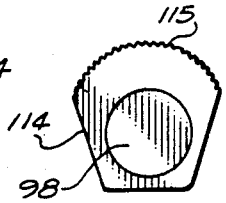
FIG. 13
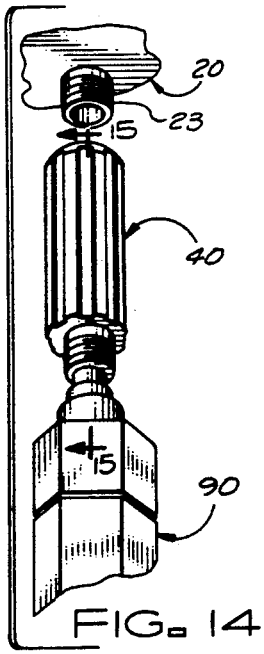
FIG. 14
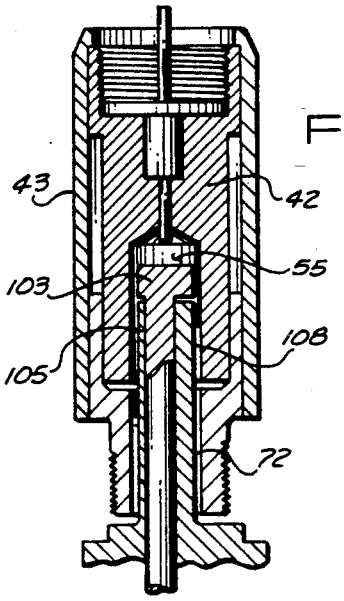
FIG. 15
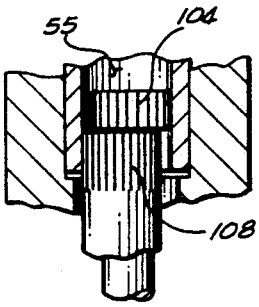
FIG. 16

TAMPER-RESISTANT CABLE TERMINATOR SYSTEM

CROSS-REFERENCE TO RELATED APPLICATION

This application is a division, of application Ser. N. 402,895, filed Sep. 5, 1989now U.S. Pat. No. 5,055,060, which is a continuation-in-part of copending application Ser. No. 360,777, filed Jun. 2, 1989, now abandoned; entitled TOOL FOR TAMPER-RESISTANT CABLE TERMINATOR.

BACKGROUND OF THE INVENTION

1. Field of the Invention

This invention relates to cable transmission systems.

More particularly, the present invention relates to devices of the type normally employed for terminating an outlet of a cable transmission system.

In a further and more specific aspect, the instant invention concerns improvements in the installation and removal of tamper-resistant cable terminators.

1. The Prior Art

Cable transmission systems for the transfer of signals between devices are well known. Exemplary is the common cable antenna television (CATV) system in which coaxial cable provides signal communication between a central antenna and remotely located receiver sets. In a commercial system, access is by paid subscription.

Briefly, the conventional system includes a permanently installed cable extending from the antenna throughout the area to be served. A plurality of devices, such as directional taps, are spaced along the cable. Each subscriber is serviced by a drop line connected to a selected terminal of the device. A terminator is affixed to each of the unused terminals.

The terminals are usually readily accessible to the public. Accordingly, to prevent unauthorized access to the system, the prior art has provided a type of terminator referred to as tamper-resistant or theft-proof. A special tool, not generally available to the public, is required for installation and removal.

A common tamper-resistant terminator includes a connector body which is rotatably contained within a coaxial shield. The body includes an axial bore with a pair of radially extending, diametrically opposed recesses. The complementary tool includes an elongate shaft which is receivable through the shield and into the bore of the connector body. A pair of diametrically opposed lugs, extendably and retractably carried by the shaft, are selectively engageable within the recesses.

The foregoing means, including the tamper-resistant terminator and the companion tool, adequately provide for the security of a cable transmission system. However, the arrangement has not proven to be entirely satisfactory. For example, the tool incorporates a number of relatively small interacting components which result in a rather delicate and expensive structure. Excessive machining operations, especially for cutting the recesses within the bore, add extraneous costs to the terminator. Further, since precise alignment between the terminator and the tool are mandatory, even the slightest damage or the presence of foreign material can render the assembly inoperative.

It would be highly advantageous, therefore, to remedy the foregoing and other deficiencies inherent in the prior art.

Accordingly, it is an object of the present invention to provide improvements in terminators for coaxial cable.

Another object of the invention is the provision of improvements especially adapted for use in connection with tamper-resistant cable terminators.

And another object of the invention is to provide improved means for the installation and removal of a tamper-resistant terminator in a cable transmission system.

Still another object of the immediate invention is the provision of an improved tamper-resistant terminator of amplified construction.

Yet another object of the invention is to provide means for engagement between a tamper-resistant terminator and an installation tool which is immune to the usual effects of dirt and other contaminates.

Yet still another object of the invention is the provision of improved means for sealing the connection between a terminator and a device.

A further object of the instant invention is to provide improvements in tools for rotating tamper-resistant type cable terminators.

And a further object of the invention is the provision of a simplified tool which is exceptionally durable thereby having an extended maintenance free service life.

Yet a further object of this invention is to provide a tamper-resistant terminator system which will expedite field operations.

And yet an object of the invention is the provision of means and improvements according to the foregoing which will materially reduce the cost of terminating an unused terminal.

SUMMARY OF THE INVENTION

Briefly, to achieve the desired objects of the instant invention first provided is a tamper-resistant terminator especially adapted for use in combination with a cable transmission system which includes a device having an element of a rotational male/female engagement pair. In accordance with the preferred embodiment thereof, the terminator includes a body which is rotatably encapsulated within a shield. The body includes a complemental element of the engagement pair and a socket for receiving a body rotating tool. The shield includes a first port for receiving the element of the device therethrough for engagement with a complemental element of the engagement pair and a second port for passage of the tool therethrough into the socket.

More specifically, the socket includes an open end for receiving the tool therethrough, an inner end spaced from the open end and a continuous sidewall extending between the ends. Preferably, the sidewall is defined by a smooth cylindrical surface. The complemental element and the socket are coaxial with an axis about which the shield is rotatable.

In a preferred embodiment, the shield includes a first member having a bore forming one of the ports and a counterbore for rotatably receiving the body. The shield further includes a second member which is engageable with the first member for retaining the body within the counterbore and a second coaxial bore forming the other of the ports. A first annular shoulder intermediate with the bore and the counterbore of the first member receives an end of the body thereagainst. A second annular shoulder carried by the second member and opposing the first annular shoulder receives the other end of the body thereagainst. The second member may be frictionally engaged with the first member. Additionally, an annular seal may be carried by a mating groove formed into the body for sealing engagement with the counterbore of the shield. The seal prevents flow of moisture and contaminates within the shield between the first and second ports.

Next provided is a tool having first and second members concurrently receivable within the bore of a theft-proof cable terminator. Actuating means moves the second member relative the first member between a first position in which the members are telescoping movable within the bore of the terminator and a second position in which the members are drivingly engaged with the bore of the terminator. Preferably, the second member is substantially concentric with the first member in first position and substantially eccentric with the first member in second position.

In accordance with a more specific embodiment, the first member extends coaxially along a first longitudinal axis and the second member is rotatable about a second longitudinal axis which is substantially parallel to and spaced from the longitudinal axis. Further, the members may be serially aligned and include friction enhancing means for reinforcing the engagement with the bore of terminator.

The tamper-resistant terminal and the tool comprise a system for terminating an unused terminal and preventing unauthorized access to a cable transmission system. The system may further include a seal member for normally affecting a sealing engagement between the device and the terminator when the terminator secured to the device. Preferably, the seal member is generally cylindrical and elastically embraces the element of the engagement pair carried by the device. In accordance with an alternate embodiment, the seal may have a bore therethrough and carrying a female element matingly engageable with the male element of the terminal. To enhance the sealing engagement, the female element carried by the seal may be smaller then the male element of the terminal t constrictively embrace the terminal. A frusto-conical surface carried by the shield lifts and receives the seal member a the terminator is secured to the device. Also provided are closure means for selectively closing and sealing the second access port of the shield.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 6 is a perspective view of a tool, constructed in accordance with the teachings of the instant invention, especially adapted for installation and removal of a tamper-resistant terminator, the tool being shown in the release position for insertion into a tamper-resistant terminator;

FIG. 7 is a fragmentary perspective view, generally corresponding to the view of FIG. 6, and showing the tool in the engagement position;

FIG. 8 is a fragmentary vertical sectional view taken along the line 8—8 of FIG. 7;

FIG. 9 is a vertical sectional view taken along the line 9—9 of FIG. 8;

FIG. 10 is an elevational view of the end of the tool seen in FIG. 8;

FIG. 11 is a fragmentary exploded perspective view of the end of the tool seen in FIG. 8;

FIG. 12 is a fragmentary perspective view of the end of an alternate embodiment of the tool of the instant invention;

FIG. 13 is an enlarged end elevational view of the embodiment seen in FIG. 12;

FIG. 14 is a fragmentary perspective view illustrating the use of the tool for engaging a tamper-resistant terminal with a device in a cable transmission system;

FIG. 15 is an enlarged vertical sectional view taken along the line 15—15 of FIG. 14;

FIG. 16 is an enlarged fragmentary portion of the illustration of FIG. 15 and showing the tool thereof in the engagement position for rotating the tamper-resistant terminal;

DETAILED DESCRIPTION OF THE PREFERRED EMBODIMENTS

Figures 1, 2, 3, 4, 5:
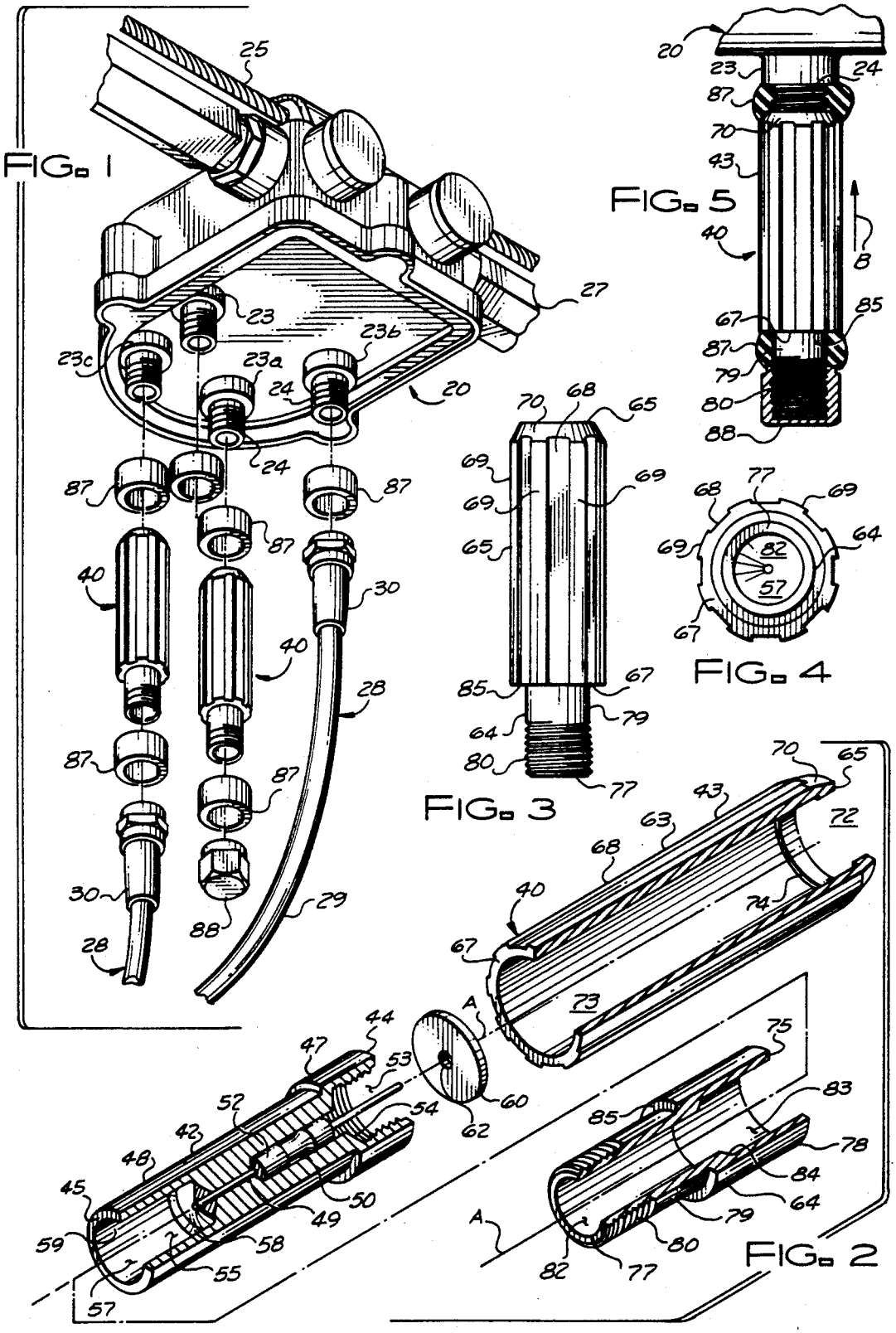
FIG. 1 is a partially exploded perspective view of a fragmentary portion of a cable transmission system and especially showing a terminator system embodying the principles of the instant invention.
FIG. 2 is an exploded perspective view, partly in section, of a tamper-resistant terminator constructed in accordance with the teachings of the instant invention.
FIG. 3 is a side elevational view of the terminator of claim 2.
FIG. 4 is an end elevation view taken from the lower end of FIG. 3.
FIG. 5 illustrates the terminator of the instant invention as it would appear with other components of the terminator system of the instant invention and secured to a selected device in a cable transmission system, portions thereof being broken away for purposes of illustration.

Turning now to the drawings in which like reference characters indicate corresponding elements throughout the several views, attention is first directed to FIG. 1 which illustrates a fragmentary portion of a cable transmission system including a device generally designated by the reference character 20 having a plurality of depending terminals 23, each including a generally cylindrical externally threaded member 24. Specifically illustrated as a directional tap in an airborne cable antenna television (CATV) system, device 20 is suspended from supporting cable 25 and is connected in series with primary coaxial cable 27 which transmits signals from a central antenna throughout the area served by the CATV system. A drop line, generally designated by the reference character 28, provides service to each subscriber. Each drop line 28 includes a coaxial cable 29 and a connector 30 which is mechanically and electrically securable to a selected one of the terminals 23.

The foregoing brief description, set forth the purposes of reference and orientation in connection with the ensuing detailed description of the invention, is intended to be generally representative of cable transmission systems. Further and more specific details and similar systems having analogous components will be readily appreciated by those skilled in the art. Exemplary is the cable transmission system known as a local area network (LAN) wherein a plurality of peripheral computer terminals are remotely located from a main computer.

Commonly, several types of connections each having a singular purpose are made with the several terminals of a device. An unused terminal, such as the terminal represented by the reference character 23*a*, is terminated with a tamperresistant terminator to prevent unauthorized access to the signal carried by primary cable 27. Service to an authorized user is provided through connection of the respective drop line to a selected terminal such as represented by the terminal 23*b*. Where service has been disconnected, a tamper-resistant terminator is interposed between the terminal and the drop line as seen with reference to the terminal designated 23*c*. Provided by the instant invention are several individually usable inventive components which taken together comprise a novel and improved system for effecting the several connections with the terminals of the device.

Reference is now made to FIG. 2 which illustrates a tamper-resistant terminator, generally designated by the reference character 40, embodying the principles of the instant invention and including a body 42 and a shield 43. Body 42, preferably fabricated of a conductive metallic material such as aluminum or brass, includes first end 44, second end 45, major diameter outer cylindrical surface 47 adjacent end 44 and coaxial minor diameter outer cylindrical surface 48 extending from second end 45. Intermediately located bore 49 and counterbore 50, coaxial with the outer cylindrical surfaces 47 and 48 along the longitudinal axis represented by the broke line A, house resistor 52 which provides the necessary terminal impedance as will be readily appreciated by those skilled in the art.

Bore 53, extending inwardly from first end 44, coaxial with the axis A and terminating with shoulder 54, is threaded for detachable securement to the externally threaded cylindrical member 24 of a selected terminal 23. Bore 55, coaxial with the longitudinal axis A, extends inwardly from second end 45. Bore 55 is defined by an open end 57, inner end 58 and a smooth continuous cylindrical surface 59 extending therebetween. The term "continuous" as used herein refers to the absence of slots, grooves or other irregularities which would breach the integrity of the smooth surface. Bore 55 functions as a socket for receiving and engaging a rotating tool as will be described presently. Gasket 60, sized to be received within bore 53 and having opening 62 to accommodate resistor 52, may be employed if desired to provide a seal between shoulder 54 and the end of the selected terminal 23.

Shield 43 comprises first member 63 and second member 64. First member 63 includes first end 65, second end 67 and outer surface 68. Outer surface 68, as seen with additional reference to FIGS. 3 and 4, carries a plurality of radially spaced longitudinally extending ribs 69. Ribs 69 function as a preferred grip receiving means. Frusto-conically beveled surface 70 terminates outer surface 68 adjacent end 65. The function of ribs 69 and of surface 70 will become clear as the description ensues.

First member 63, both ends of which are open, includes bore 72 and counterbore 73 which are coaxial with the axis A. Counterbore 73, which extends inwardly from second end 67, terminates with shoulder 74 approximate end 65. Counterbore 73 rotatably receives major diameter outer cylindrical surface 47 of body 42. First end 44 of body 42 is receivable against shoulder 74. Bore 72 functions as an access port for receiving the threaded member 24 of a selected terminal 23 therethrough for engagement with the threaded bore 53 of body 42.

Second member 64 includes first end 75, second end 77, major diameter outer cylindrical surface 78 adjacent end 75 and minor diameter outer cylindrical surface 79 adjacent end 77. An external thread 80, corresponding to the thread carried by threaded member 24 of device 20, extends along the terminal portion of surface 79 adjacent end 77. Being generally cylindrical and open at each end, second member 64 further includes bore 82 and counterbore 83. Counterbore 83 projects inwardly from end 75 and terminates with annular shoulder 84. The several elements of second member 64 extend coaxially along the axis A.

Surface 78 of second member 64 is engageable with counterbore 73 of first member 63. Preferably, surface 78 is sized to be frictionally engaged or press-fitted into counter bore 73. Various bonding mediums, as are well-known in the art, may also be employed to effect the engagement. Preferably, the first end 75 of second member 64 is inserted into the bore 73 of first member 43 until the annular shoulder 85 intermediate surfaces 78 and 79 is flush with the second end 67 of first member 43. Counterbore 83 is sized to rotationally receive the minor diameter cylindrical surface 48 of body 42. Second end 45 of body 42 is receivable against the annular shoulder 84. Thus, body 42 is rotationally encapsulated within shield 63. Bore 82 functions as an access port for receiving a rotating tool therethrough for engagement within the socket provided by bore 55 of body 42.

Attention is now directed to FIG. 5 wherein there is illustrated a preferred means of terminating an unused terminal as exemplified by the terminal 23*a* of device 20. An annular elastic seal member 87 is first positioned upon the threaded member of the terminal. The internal diameter of member 87 is sized to sealingly embrace the thread. In response to rotational engagement of the threaded bore 53 of body 42, shield 43 advances in the direction indicated by the arrowed line B. As the shield 43 moves, frusto-conically beveled surface 70 engages and lifts the initial portion of seal member 87 for sealing engagement about the terminal portion thereof. Further provided by the instant invention is an end cap 88 which is threadedly engageable with the terminal portion of second member 64. A second seal member 87, encircling the surface 79, seals the threaded union. The second seal member 87 further abuts the end 67 of first member 63 and the annular shoulder 85 of second member 64 to insure, if necessary, a seal between first member 63 and second member 64. Ribs 69 serve to enhance stabilizing shield 43 against rotation, either by hand or by the use of a tool such as a pair of pliers, during attachment and removal of the cap 88.

Returning again to FIG. 1, terminator 40, seal members 87 and cap 88 are illustrated prior to engagement. With particular reference to the terminal designated 24*c*, it is seen that cap 88 may be removed for alternate attachment of a drop line which has been removed from service. The second seal member 87 sealingly engages the connector 30 in a manner analogous to cap 88. Further seen is the use of a seal member 87 for the stated purpose between a terminal and a connector. It will be appreciated that a seal member associated with a terminal will alternately accept either a connector or the terminator of the instant invention.

Attention is now directed to FIG. 6 which illustrates a tool, generally designated by the reference character 90, constructed in accordance with the teachings of the instant invention and especially adapted for installation and removal of the previously described terminator 40. The tool is also usable in connection with prior art terminals such as the device distributed by GILBERT ENGINEERING COMPANY, Phoenix, Arizona under the designation "F" Series Male Terminator, Theft-Proof, Part No. GTP-59. With further reference to FIG. 8, it is seen that tool 90 includes a handle 92 having a first portion 93 and a second portion 94. The portions are serially aligned that is, the forward end 95 of first portion 93 resides in juxtaposition with the rearward end 97 of second portion 94.

Shaft 98, drivingly engaged with first portion 93, projects from forward end 95. In accordance with a preferred method of manufacture, a terminal portion of shaft 98 adjacent fixed end 99 is fitted into bore 100 to extend along a first longitudinal axis represented by the broken line C. In accordance with the immediately preferred embodiment of the invention, shaft 99 is retained by set screws 102 in accordance with conventional practice. Alternately, shaft 99 may be press-fitted or bonded into bore 100. Disc 103 having knurled outer surface 104 is carried at the free end of shaft 98. Outer cylindrical surface 104 is coaxial with a second longitudinal axis represented by the broken line D which is parallel to and spaced from the first longitudinal axis represented by the broken line C. Accordingly disc 103 is considered to be eccentric to shaft 98.

Shaft 105, projecting forwardly from the second portion 94 and drivingly engaged therewith, terminates with free end 107 residing in close relationship with disc 103. A knurled terminal portion 108 resides adjacent free end 107. Bore 109, extending continuously through second portion 94 and shaft 105, is rotatably journalled upon shaft 98. Bore 109, coaxial with shaft 98, extends along the first axis represented by the broken line C. Externally, shaft 105 and knurled terminal portion 108 are coaxial with a third axis represented by the broken line E which is spaced from and parallel to the first axis represented by the broken line C as further seen in FIG. 9.

The first axis, represented by the broken line C, is equidistant from the second and third axes represented by the broken lines designated D and E, respectively The knurled outer cylindrical surface 104 of disc 103 has approximately the same measurement as the outside diameter of the knurled terminal portion 108 of shaft 105. Accordingly, in response to relative rotation between first portion 93 and second portion 94 of handle 93, disc 103 is movable between a first position, as seen in FIG. 6, in which disc 103 and shaft 105 are substantially concentric; and a second position, as seen in FIGS. 7 and 10, in which disc 103 and knurled terminal portion 108 are eccentric.

Shaft 98 and disc 103 are readily fabricated in accordance with various well-known procedures considered to be standard in the art. Preferably, as viewed in FIG. 11, a reduced diameter terminal portion 110 terminating with annular shoulder 112 is formed on shaft 98. Terminal portion 110, which is concentric with the longitudinal axis of shaft 98, has a length which generally corresponds to the thickness of disc 103. Bore 113 is formed through disc 103 along a longitudinal axis which is spaced from the longitudinal axis of outer surface 104 an amount equal to the distance between the previously described axes C and E. Various means may be employed for retaining disc 103 upon shaft 98. For example, bore 113 may be sized to be press-fitted upon the reduced diameter portion 110. Alternately, bore 113 may be sized to locationally receive reduced diameter portion 110 and thereafter bonded by any well-known technique, such as brazing.

As will be described presently in greater detail, knurled surface 104 opposes knurled surface 108 for camming engagement with the socket of the terminator. Only the portion of knurled surface 104 which projects from and opposes the knurled surface 108 is required for the engagement. FIGS. 12 and 13 illustrate an alternate embodiment of the invention which is believed to provide better engagement. Seen is a disc segment 114 having an arcuate knurled section 115. Segment 114 is secured to shaft 98 as previously described for eccentric movement relative the longitudinal axis of shaft 98. It will also be appreciated that the arcuate section 115 need not be uniformly cylindrical.

FIG. 14 illustrates the use of tool 90 for engagement and disengagement of terminator 40 with a selected terminal 23 of device 20. In the first position, as seen with reference to FIG. 15, shaft 105 and disc 103 are telescopingly receivable through bore 72 of shield 43 into bore 55 of body 42. Shaft 105 is of sufficient length to place at least a portion of knurled terminal portion 108 within bore 55. As shaft 105 and disc 103 are moved toward the second position, in response to relative rotation between the handle sections 93 and 94, as seen in FIG. 16, surfaces 104 and 108 are cammingly urged into driving engagement with bore 55. In the second position, which also may be referred to as the engagement position, the body portion 42 of terminator 40 is drivingly engaged with tool 90 for installation and removal relative terminal 23 as seen in FIG. 14. After the installation or removal, terminator 40 is released from tool 90 in response to counterrotation of the handle portions 93 and 94.

Figure 17:
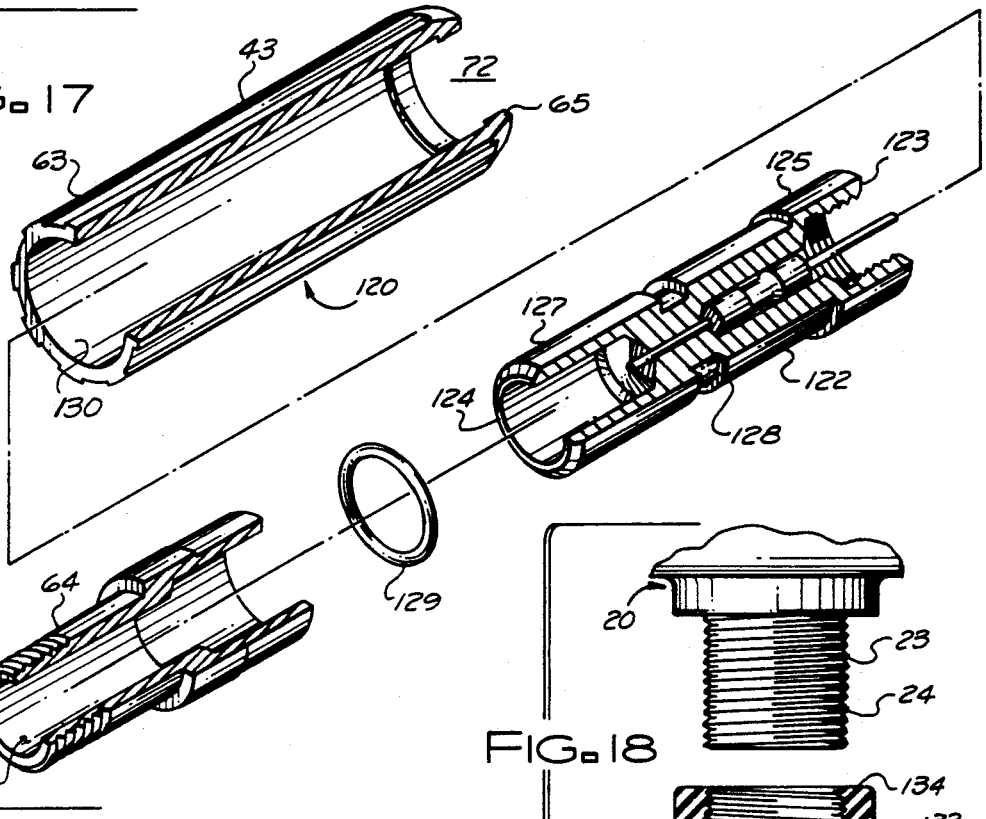
FIG. 17 is a view generally corresponding to the illustration of FIG. 2 and illustrating an alternate embodiment thereof.

Reference is now made to FIG. 17 wherein there is seen an alternate embodiment of a terminator, constructed in accordance with the teachings of the instant invention and generally designated by the reference character 120 including shield 43 having first member 63 and second member 64 as previously described. Alternate body 122, in general similarity to previously described body 42 includes first end 123, second end 124 major diameter outer cylindrical surface 125 and minor outer diameter cylindrical surface 127. The immediate body is modified by annular groove 128 formed in minor diameter outer cylindrical surface 127 for purposes of receiving and retaining annular seal 129 herein illustrated as a conventional commercially available 0-ring. Annular seal 129 sealingly engages the surface of groove of 128 and the internal cylindrical surface 130 of shield 43 to prevent the flow of contaminates within shield 43 between the open ends 65 and 77. Hence, previously end cap 88 and the associated seal 87 may be eliminated if desired.

Figure 18:
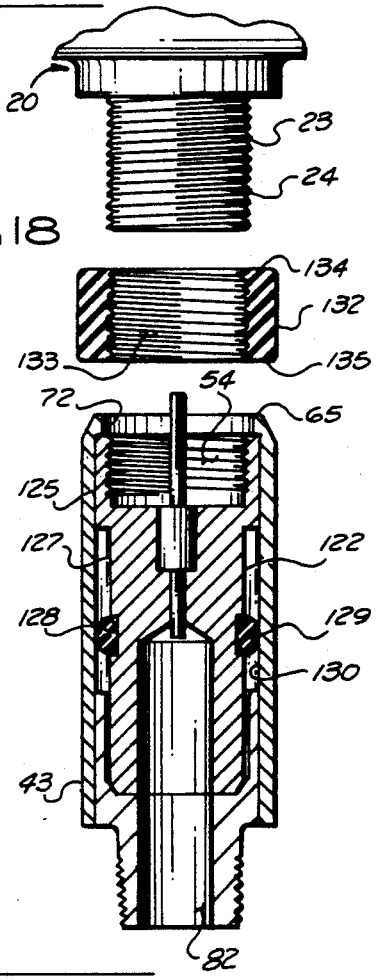
FIG. 18 is a vertical sectional view taken along the longitudinal axis of the assembled embodiment seen in FIG. 17 and further illustrating an alternate embodiment of a seal especially adapted for sealing the engagement between the terminator and a terminal of a device.

FIG. 18 illustrates annular seal 129 as it would appear in sealing engagement with the annular groove 128 carried by body 122 and the concentric cylindrical surface 130 of shield 43. Also seen in the immediate illustration is seal 132, an alternate embodiment of previously described seal 87 for sealingly engagement between a terminator of the instant invention and a terminal 23 of device 20. Seal 132 includes bore 133 extending through seal 132 carries an internal thread which is matingly received by the externally threaded cylindrical member 24 of terminal 23. As will be appreciated by those skilled in the art, the thread carried by member 24 has a diameter and a pitch of finite measurement. Preferably, seal 132 is fabricated of a resilient material. To enhance the sealing engagement between seal 132 and the terminal 23, it is preferred that the thread within bore 133 has a pitch which corresponds to the pitch of member 24 and a diameter which, in the free state, is smaller than the diameter of member 24. Further, seal 132 includes a first surface 134 which is receivable against the device 20 and a second surface 135 which is receivable against the end of the terminator. In the foregoing description, it is understood that the external thread carried by member 24 and the internal thread carried by bore 133 is generally representative of any selected male/female engagement pair.

Various changes and modifications to the embodiments herein chosen for purposes of illustration will readily occur to those skilled in the art To the extent that such modifications and variations do not depart from the spirit of the invention, they are intended to be included within the scope thereof which is assessed only by a fair interpretation of the following claims Having fully described the invention in such clear and concise terms as to enable those skilled in the art to understand and practice the same, the invention claimed is:

We claim:

1. A tool especially adapted for use in combination with a cable transmission system, said system including:

a cable terminal having an element of a rotationally engagable male/female connection pair, and a tamper-resistant terminator having a complemental element of said connection pair and a bore coaxial with said connection pair, and for installation and removal of said terminator with said terminal, and tool comprising:

a handle having a first portion and a second portion serially aligned;

said first portion having a tubular shaft extending therefrom;

said second portion having a first shaft extending axially through said first portion and through said tubular shaft, and having a terminal end extending beyond a terminal end of said tubular shaft;

said tubular shaft extending coaxially with a first longitudinal axis;

said second portion and first shaft being rotatable about a second longitudinal axis which is substantially parallel to and spaced from said first longitudinal axis;

a disk eccentrically attached to said terminal end of said first shaft and rotatable therewith; and said disk being concentric in relation to said terminal end of said tubular shaft in a first position and telescopingly moveable within the bore of said terminator;

said disk being eccentric in relation to said terminal end of said tubular shaft when said first portion and said second portion are rotated relative to each other for driving engagement with the bore of said terminator.

2. The tool of claim 1 further including friction enhancing means carried by at least one of said disk and said terminal end of said tubular shaft for reinforcing the engagement with the bore of said terminator.

* * * * *